United States Patent [19]

Heinzmann

[11] Patent Number: 4,893,741

[45] Date of Patent: Jan. 16, 1990

[54] AIR GUIDE BOX FOR STABILIZING THE PATH OF A PAPER WEB

[75] Inventor: Helmut Heinzmann, Bohmenkirch, Fed. Rep. of Germany

[73] Assignee: J. M. Voith GmbH, Heidenheim, Fed. Rep. of Germany

[21] Appl. No.: 270,787

[22] Filed: Nov. 14, 1988

[30] Foreign Application Priority Data

Nov. 20, 1987 [DE] Fed. Rep. of Germany ..... 3739338

[51] Int. Cl.[4] ..... F26B 13/08; B65H 23/24

[52] U.S. Cl. ..... 226/196; 34/114; 34/116; 34/117; 34/123; 162/290; 162/375; 226/97

[58] Field of Search ..... 34/114, 116, 117, 120, 34/122, 123, 156; 226/7, 95, 97, 196; 162/207, 290, 375

[56] References Cited

U.S. PATENT DOCUMENTS

| | | | |
|---|---|---|---|
| 4,502,231 | 3/1985 | Fissmann et al. | 34/116 |
| 4,602,439 | 7/1986 | Eskelinen et al. | 34/116 |
| 4,628,618 | 12/1986 | Virta et al. | 34/122 |
| 4,669,198 | 6/1987 | Wedel | 34/116 |

*Primary Examiner*—Karen Hastings

*Attorney, Agent, or Firm*—Albert L. Jeffers; Richard L. Robinson; Anthony Niewyk

[57] ABSTRACT

The present invention is an air guide box. The box has a guide wall intended to lay adjacent to a running web. The guide wall has an air suction channel and a discharge opening. A drive jet blows air into the air suction channel to create suction, with the air being expelled through the discharge opening.

14 Claims, 3 Drawing Sheets

AIR GUIDE BOX FOR STABILIZING THE PATH OF A PAPER WEB

BACKGROUND OF THE INVENTION

The field of the invention is that of air guide boxes. More specifically, the field is that of air guide boxes for stabilizing a paper web.

Air guide boxes are usable for various applications. In conjunction with paper making machines, an air guide box may be used to guide:

(a) a paper web, which together with a backing belt, running from a roll (e.g., a drying cylinder) to an adjacent roll (e.g., a successive drying cylinder);

(b) a paper web running without a backing belt from a roll or a nonrotating bar to a second roll or a second nonrotating bar;

(c) a paper web being wound on a paper roll.

Also, those air guide boxes are usable outside the paper machine technology whenever webs, such as textile webs, are subjected to a similar handling.

An example of an air guide box is described in U.S. Pat. No. 4,628,618 (Virta). Provided on this air guide box, endwise, are air blocking strips formed by side plates or ejector devices. The ejector devices consist of a nozzle arranged at a distance from the material web. That web consists of backing belt and adhering paper web. The nozzle blows at entering leakage air to keep the leakage air flow pushing into the gap between the first wall of the air guide box, the guide wall, and the material web at a minimum.

More generally, the purpose of the air blocking strips is to enable the adjustment, i.e., control of the flow conditions in the air gap. Thus, the vacuum profile between the air guide box and the material web is controlled, as far as possible solely by blowing air supply into the air guide box.

The basic disadvantage of the simple mechanical strips is wear, considering that the backing belts opposite the strips have edges where they are abutted together. Furthermore, mechanical strips have the disadvantage that the marginal flutter of the material web allows undefined leakage flow.

Ejector devices have the disadvantage of blowing against the run direction of the material web and at the marginal area of the web, thereby possibly even furthering the endwise flutter. The energy of the drive jet issuing out of the ejector device needs to be determined directly in contingence on the leakage air amount which is to be expected due to the distance between ejector and web.

The prior ejector devices thus require relatively large amounts of air which, additionally, must "push" against the leakage air with a relatively large kinetic energy.

SUMMARY OF THE INVENTION

The present invention concerns an air guide box for stabilizing a running web, such as a paper web, which transverse to the running direction of the web extends at least across part of the web width and features a so-called guide wall which, viewed in cross-section, extending along the running path of the web, with an air gap forming between the guide wall and the web, and where a device is provided for influencing the air contained in the air gap by means of a drive jet.

The problem the present invention solves involves providing an air guide box where the drive jet for influencing the air cushion in the air gap is not directed directly at the web, specifically a paper web, but where said drive jet influences the leakage air flow that enters the air gap, at a distance from the web. Thus, the drive jet influences the influx of the leakage air only indirectly, which ultimately results also in a reduction in the amount o air required for the drive jet.

The problem is solved by an air guide box which features on at least one of its marginal zones an air suction channel that originates from an air suction slot in the guide wall and leads to a discharge opening which is provided on the air guide box some distance from the web, with the drive jet emptying in the air suction channel in such a way that the channel will suck from the web a part of the air boundary layer moving with the web.

Additionally, the air suction channel may be provided both on the endwise marginal zones of the web and, viewed across the web width, at the approach point between web and air guide box, and at that, alternatively and cumulatively. In a specific design of this air guide box, a boundary layer splitter may be provided with a pipe which strips a part of the air boundary layer entrained by the web, prior to entering the air gap. This improves the air volume balance for the drive jet. Another design of the air guide box has the ventilation of the entrance gore between web and roll included in the overall air supply.

With the present invention, the marginal area of the web floats on an air cushion, so that physical contact between the air blocking strip and the backing belt is avoided and the leakage flow can be kept extensively constant. Thus, an air guide box can be designed where both on the approach edge and the endwise marginal edges there are assured an ejector effect initiated by the drive jet, a good seal against leakage air and a quiet run of the web. The invention will be more fully explained hereafter with the aid of the drawing.

DESCRIPTION OF THE PREFERRED EMBODIMENT

Figure 1:
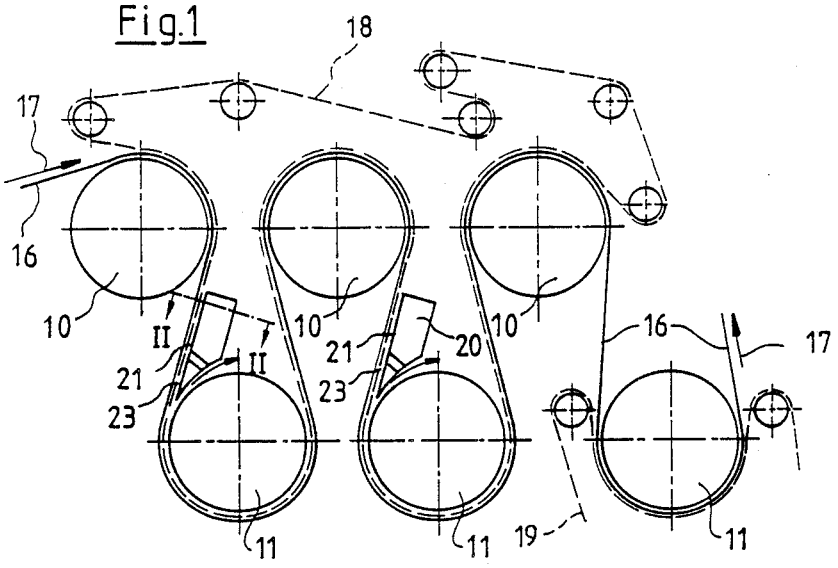
FIG. 1 shows a schematic section of a drying section of a paper machine.

The drying cylinders 10 or 11 illustrated in FIG. 1 form a drying group of a drying section of a paper machine. The right hand drying cylinder in the drawing is already part of a following drying group. The drying cylinders 10 are arranged in an upper row, the cylinders 11 in a lower row. The paper web 16 to be dried meanders across the drying cylinders in the direction of arrow 17. Within the first drying group the web is constantly accompanied by a continuous, air permeable backing belt (drying screen) 18. The drying cylinders 10 of the upper row lie outside the loop formed by the backing belt 18; the cylinders 11 of the lower row lie within it. Thus, the paper web 16 runs in the area of the upper cylinders 10 between their cylinder surface and the backing belt 18. In the area of the bottom cylinders 11, the paper web 16, contrarily, is located on the outside of the backing belt 18 which is in contact with these cylinders 11. In the free sections between respective cylinders, the paper web 16 is supported by the backing belt 18. A free paper train exists for the first time between the two right hand cylinders. In the following drying groups, each cylinder row has a backing belt 19 of its own.

On the common path of the paper web 16 and the backing belt 18, from an upper drying cylinder 10 to a lower cylinder 11, an air guide box 20 is provided on the side of the backing belt. Designed rigid and having the length of the web width or less, each of these air guide boxes 20 extends crosswise through the entire drying section. Shorter air guide boxes are preferably arranged in the marginal areas of the paper web. An air guide box 20 extending across the entire web width will be described hereafter in detail.

Figure 2:
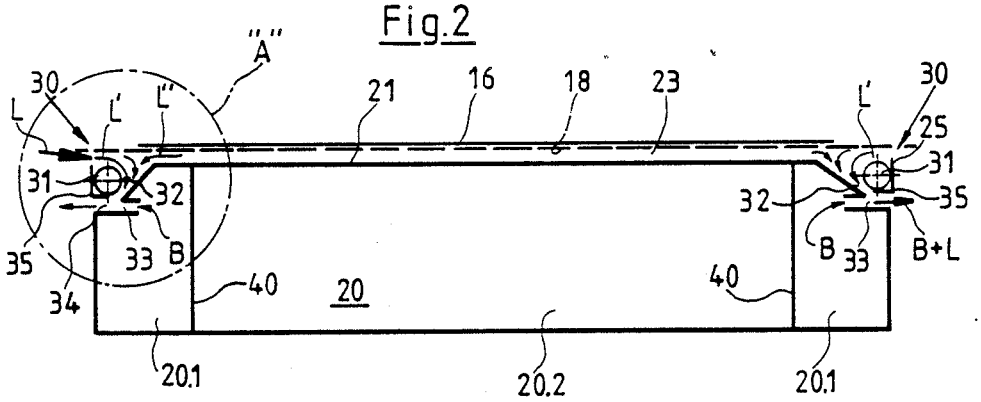
FIG. 2 shows an air guide box of the present invention viewed in the run direction of the web along sectional lines II according to FIG. 1.

In FIG. 2, this air guide box 20 is illustrated, cross-sectionally, in the direction of travel of the web.

Essentially closed on all sides, the air guide box 20 has a first wall, the guide wall 21, which, as viewed in the cross-section of air guide box 20, extends along the backing belt 18 up into the inlet gore formed by it and the free cylinder surface of the lower drying cylinder 11. Remaining between the guide wall 21 and the backing belt 18 is an air gap 23 which in known fashion may diverge toward the inlet gore.

Viewed in the direction from an upper drying cylinder 10 toward the lower drying cylinder 11, this air guide box has approximately rectangular shape. The guide wall 21 is a straight edge extending crosswise through the drying section, which edge is opposed, spaced by the air gap 23, by the backing belt 18 with the paper web 16, approximately parallel.

The air guide box 20 has a rectangular cross-section, whose top side is the guide wall 21 which, in turn, is opposite the backing belt 18 with the adhering paper web 16. Contained between the guide wall 21 and the backing belt 18 is a space, the air gap 23, which determines the full effect of the air guide box 20.

Figure 3:
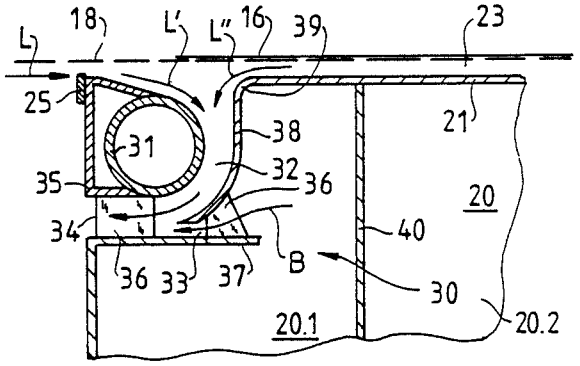
FIG. 3 shows the detail "A" according to FIG. 2, an endwise ejector device of the present invention.

The air gap 23 is partly sealed, sideways, by means of mechanical air blocking strips 25 (for instance felt strips) which are located a certain distance from the path of the backing belt 18 so as not to damage it (refer to FIG. 3). These air blocking strips 25 act as a resistance, sort of a shield, against the uncontrolled penetration of leakage air L in the air gap 23. Leakage air L′ which enters nonetheless is neutralized by means of an ejector device 30, which is designed as follows.

The lengthwise edge of the air guide box 20 consists preferably of a round, cylindrical pipe 31 to which, toward the backing belt 18, an air blocking strip 25 is attached. Along the air guide box 20 (perpendicular to the drawing plane) the pipe 31 is firmly connected with the air guide box 20 through a number of braces (not shown). This creates between the pipe 31 and the adjacent marginal area of the air guide box 20 an air suction channel 32 that extends along the edge of the air guide box 20. In the preferred embodiment, this air suction channel is located in the marginal area of the paper web 16, the width of which is smaller than the width of the backing belt 18. Thus, the air suction channel 32 is limited and fluidically determined by the pipe 31 and the edge fashioning on the air guide box 20. In FIG. 2, this edge design has the air guide box 20 beveled approximately less than 45° at the respective edge, but it is also conceivable to give this edge of the air guide box 20 a round design coaxial with the pipe 31 (see FIG. 3).

Provided below the pipe 31 is a nozzle gap 33 which, in cross-section, is narrower than the drain channel 32 and, tangential to the pipe 31, extends approximately perpendicularly to the front of the air guide box 20. In the marginal area of the air guide box 20, the air suction channel 32 and the nozzle gap 33 extend into one another forming an air blow channel 34.

A drive jet B, in the form of blowing air, discharges through the nozzle gap 33 approximately perpendicularly to the front of the air guide box 20. The leakage air L′, located between the backing belt 18 and the pipe 31, which can still penetrate despite the air blocking strip 25, is attracted by the suction effect of the drive jet B and discharged with it through the air discharge channel 34. Thus, the backing belt 18 is not being blown at, leaving the marginal area of the backing belt 18 and the paper web 16 undisturbed, enabling it to smoothly slide along the air guide box 20. Regarding the air volume balance in the air discharge channel 34, it should be noted that air L″ can be sucked in or off also from the air gap 23. This suction effect can be influenced, specifically favored, by an appropriate design of the edge between the guide wall 21 and the air suction channel 32.

To prevent the discharged air consisting of leakage air L′ and L″ and the blowing air B (drive jet) from proceeding helically around the pipe 31 and again into the air gap between the pipe 31 and the backing belt 18, an air stripping edge 35 is provided in the plane of the front of the air guide box 20, on the pipe 31.

To be able to operate the ejector device 30 faculatively with blowing air of a higher flow velocity, i.e., greater energy, the air guide box 20 can be partitioned, viewed across the width, by means of bulkheads 40 in lateral marginal chambers 20.1 and a center, main chamber 20.2. The marginal chambers 20.1 can now be supplied with blowing air B for the nozzle gap 33, i.e., for the drive jet, in a more defined way, whereas the main chamber 20.2 continues to be supplied normally.

The blowing air supply may be conceived both centrally and separately. In the former case, the varying pressure conditions in the separate chambers, i.e., the marginal chambers 20.1 and the main chamber 20.2, are adjusted by way of suitable air guidance and choking devices.

Illustrated in FIG. 3, enlarged, is an ejector device 30 (detail "A") of the type described with the aid of FIG. 2, for better revelation of the design realization. The air guide box 20 opposes with its guide wall 21 the backing belt 18 with the paper web 16. Forming between the backing belt 18 and the guide wall 21 is the air gap 23 that specifies the foil effect of the air guide box 20. The backing belt 18 extends beyond the width of the air guide box 20, whereas the paper web 16 retracts relative to the outside, i.e., the marginal side of the air guide box 20. According to the embodiment shown in FIG. 2, the air guide box 20 is partitioned in a lateral marginal chamber 20.1 and a main chamber 20.2, by a bulkhead 40.

The ejector device 30 comprises the design shown in FIG. 3. The corner or edge area of the air guide box 20 is formed by a pipe 31 which through a number of braces 36 is connected with the air guide box 20. The latter features on its side wall a wall 37 which is spaced from the pipe 31 and bent inward at an angle of 90° and a channel wall 38 which is bent over from the guide wall 21. This channel wall has a rounding 39 and extends approximately coaxially with the pipe 31. The wall 37 and the channel wall 38 are so adjusted to each other that the nozzle gap 33 for the drive jet B, i.e., the blowing air, is created between them. The wall 37 and the channel wall 38 are as well rigidly connected through braces 36' in the area of the nozzle gap 33.

Attached to the pipe 31, toward the backing belt 18, is the air blocking strip 25 which opposes the penetrating air L and permits only a partial air amount L' to enter in the direction toward the air gap 23. Additionally and parallel with the wall 37, a rectangular edge is attached to the pipe 31, ensuring as a stripper edge 35 that the discharging air (B+L'+L'') discharges perpendicularly and will not be deflected toward the backing belt 18.

Viewed functionally, the ejector device 30 acts in such a way that the drive jet B blown through the nozzle gap 33 will attract the partial air amount L' penetrating between the air blocking strip 25 and the backing belt 18 and the additional air amount L'' from the air gap 23, driving it outward through the air discharge channel 34. The partial air amounts L' and L'' are sucked into the air suction channel 32, with the lead end or entrance of this air suction channel 32 to be considered as a quasi air suction channel in the guide wall 21; analogously, the outlet of the air discharge channel 34 on the side of the air guide box 20 is to be termed and considered as discharge opening for the air components.

Figure 4:
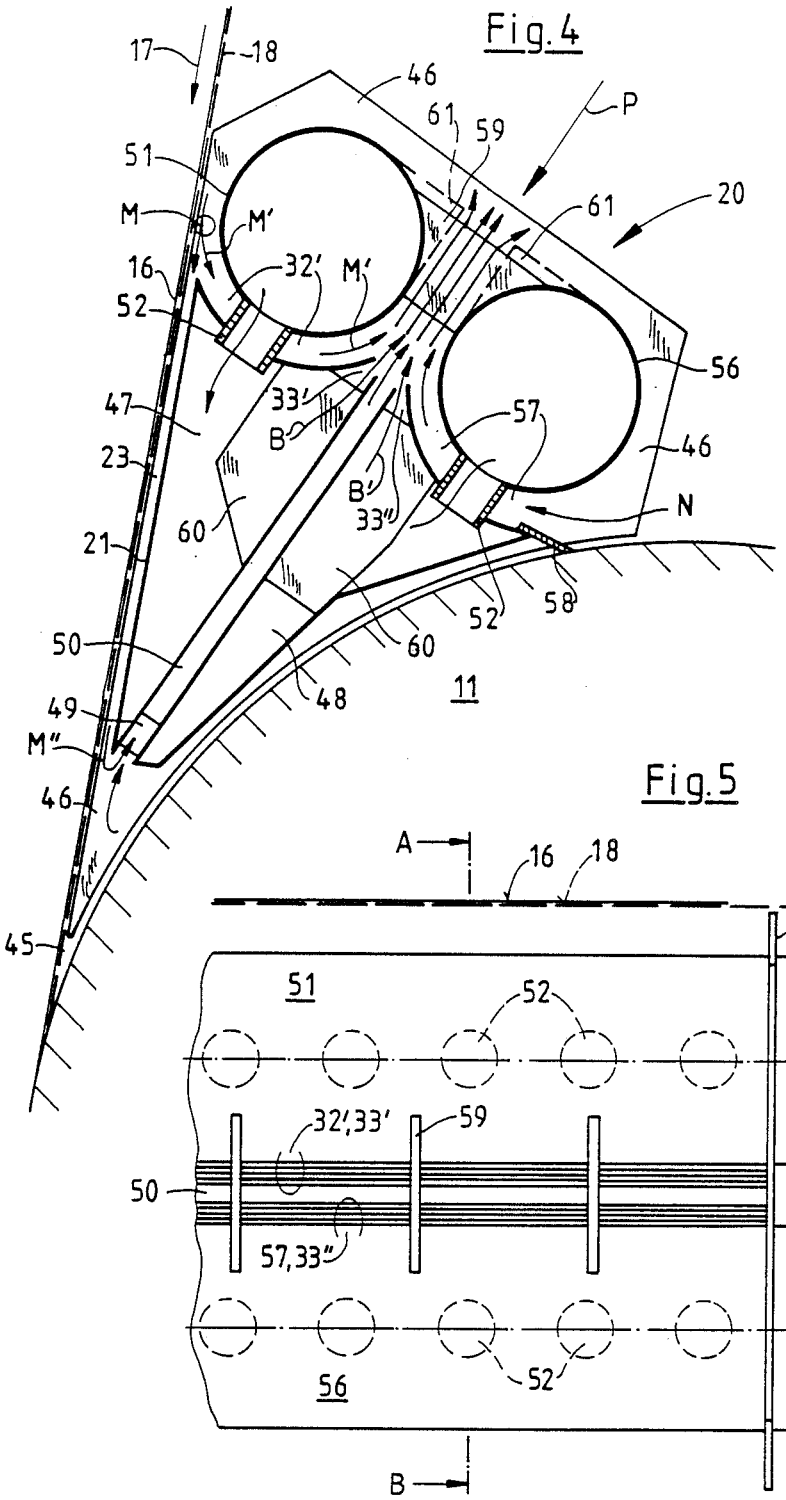
FIG. 4 shows a cross-section of an air guide box according to a first embodiment of the present invention along sectional line A-B according to FIG. 5.

Illustrated in FIG. 4 is an air guide box 20 in the view shown in FIG. 1, i.e., transverse to the running direction of the paper web 16 and backing belt 18, and at that, as a sectional view against the respective end areas. (The illustration corresponds to a section line along line A - B in FIG. 5.)

The air guide box 20 according to FIG. 4 is so arranged that it essentially opposes with its guide wall 21 the backing belt 18 with the paper web 16 while maintaining the air gap 23. Additionally it is adapted approximately to the shape of the pick-up roll 11. The air guide box 20 extends deep into the inlet gore 45 between the backing belt 18 and the pick-up roll 11 and has approximately the cross-section of an acute triangle.

Toward the respective end of the roll 11, the air guide box 20 is sealed by a side shield 46 having a basic shape such that the air guide box extends close to the backing belt 18 and close to the cylinder line of the pick-up roll 11 while extending deep into the inlet gore 45. This creates sideways a good partitioning and a relatively closed system between these end shields 46. In this respect, it should be noted that these end shields 46 can be equipped, i.e., combined on their edge opposite the backing belt 18, also with an ejector device of the type illustrated with the aid of FIGS. 2 and 3.

The air guide box 20 proper, i.e., the air guide box 20 as a design element for achieving the foil effect on the backing belt 18 with the paper web 16, consists according to the illustration in FIG. 4, viewed in cross-section, of two approximately triangular blow boxes 47 and 48, of which one (first) 47 creates the guide wall 21, is thus located opposite the backing belt 18, while a second 48 extends approximately parallel with the cylinder line of the pick-up roll 11. Mutually spaced, the two blow boxes 47 and 48 are connected with each other by means of support plates 49 so that, perpendicular to the drawing plane, a continuous gap 50 is created approximately in the direction of the angular half of the inlet gore 45. These two blow boxes 47 and 48 each form self-contained blowing air systems in that they are supplied with blowing air by a blowing air generator and they each feature an air outlet gap through which the blowing air is ejected deliberately in the form of the drive jet B.

Based on the description of the ejector device according to FIGS. 2 and 3, the air ejector gap corresponds to the nozzle gap 33' for the drive jet B. The air intake slot of the ejector device according to FIGS. 2 and 3 is formed so that the blow box 47 that opposes the backing belt 18 is round on its side opposite to the running direction 17 of the backing belt 18. Further, coaxially with this round side wall which has a pipe 52 spaced from it analogous to the design according to FIGS. 2 and 3. The free space between the blow box 47 and the pipe 51 is ultimately the air suction slot between the air suction channel 32' through which the air boundary layer M carried along by the backing belt 18 is sucked off. The nozzle gap 33' is provided on the corner of the short triangular side of the blow box 47 away from the guide wall 21, so that the ejecting drive jet B exerts a suction effect on said air boundary layer M.

The connection between the pipe 51 and the blow box 47 is such that the pipe 51 features across the width of the blow box 47 a number of blowing air distribution pipes 52 which extend into bores of the round side wall of the blow box 47. This pipe 51 is ultimately connected to a blowing air supply (not shown) and feeds the supplied blowing air through the blowing air distributing pipes 52 to the blow box 47. The supplied blowing air is then ejected in the form of the drive jet B.

With explicit reference to FIG. 4, this means then that the air boundary layer M carried along by the backing belt 18 in the direction 17 is largely deflected or stripped on the edge of the blow box 47, which is directed against the running direction 17. This partial amount M' is passed radially around the pipe 51 or in the free space (air suction channel 32') between the pipe 51 and the blow box 47 and entrained by the drive jet B discharging from the nozzle gap 32' on the edge away from the guide wall 21. On the peripheral line of the pipe 51 away from the guide wall 21, the air amount composed of the air amount of the drive jet B and the partial amount M' of the air boundary layer M sweeps thus outward.

Arranged opposite the blow box 47 forming the guide wall 21, spaced by the gap 50, is a second blow box 48. The gap 50 extends up into the inlet gore 45. A share M'' of the air boundary layer M that penetrates into the inlet gore 45 can escape through the gap 50 or can be sucked off by the suction effect of the drive jet B. The drive jet B is thus carried by the partial amount M' of the boundary air layer M that is deflected on the approach side of the air guide box 20 and by the partial amount M'' which is carried through the air cap 23 into the inlet 45. Thus, the energy of the drive jet B is absorbed on two sides and ultimately better utilized. Overall, this has a positive effect on the blowing air supply for the drive jet B.

According to FIG. 4, said second blow box 48 is integrated in the overall system of the blowing air supply of the air guide box 20.

As already mentioned, this blowing air box 48 has as well an approximately acute, triangular cross-section whose one length side is parallel with the first blow box 47 and defines the gap 50 for the suction air from the inlet gore 45. The second length side is adapted to the shape of the pick-up roll 11.

Opposite the short side of the second blow box 48, analogous to the design of first blow box 47, is a pipe 46, and this side is shaped round as well, coaxially with said pipe 56. Created between this pipe 56 and the round side of the second blow box 48 is thus as well a free space as an air channel 57.

The pipe 56 is also coupled to a blowing air generator and, through blowing air distributing pipes 52, with the second blow box 48. When now fashioning the edge of the second blow box 48 opposite the gap 50 as a nozzle gap 33", analogous to the opposite edge of the first blow box 47 an additional drive jet B' can be ejected here as well.

The stripper 58 is arranged on the approach point between the pick-up roll 11 and the air guide box 20, crosswise across its width. Air entrained by the roll 11 is largely prevented from penetrating into the inlet gore 55 by a mechanical air stripper 58. A branched air amount N is deflected in the air channel 57 and passed outside with the drive jet B' of the second blow box 48, through the channel between the pipes 51 and 56.

The air volume balance in this channel is comprised of the following flows:

Partial amount M' (of the air boundary layer)
Drive jet B (of the first blow box 47)
Suction air M" (from the inlet gore 55)
Drive jet B' (of the second blow box 48)
Amount N (stripped from the roll 11).

Regarding the design of the guide box 20 consisting of two blow boxes 47 and 48, the following should be noted: the air guide box is sideways limited by the end shields 46. The two blow boxes 47 and 48 themselves form thus by way of the lateral end shields 46 a rigid unit, with the pipes 51 and 56 for the blowing air supply being connected with the actual blow boxes 47 and 48 through said blowing air distributing pipes 52. For further stiffening of the air guide box 20 as a unit, the two blow boxes 47, 48 are fixed in the area toward the inlet gore 45 through support plates 49 which are inserted in the gap 50. The pipes 51, 56 are connected further in the area of the channels for the discharging air (M', M", B, B', N) by support plates 59. Additionally, plates 60 may be provided within the blow boxes 47, 48 in the area of the nozzle gaps 33', 33". The plates 60 are welded in place between the round, short sides of the blowing boxes 47, 48 and their long sides which define the gap 50, so that ultimately a rigid unit is obtained which will not distort.

Figure 5:
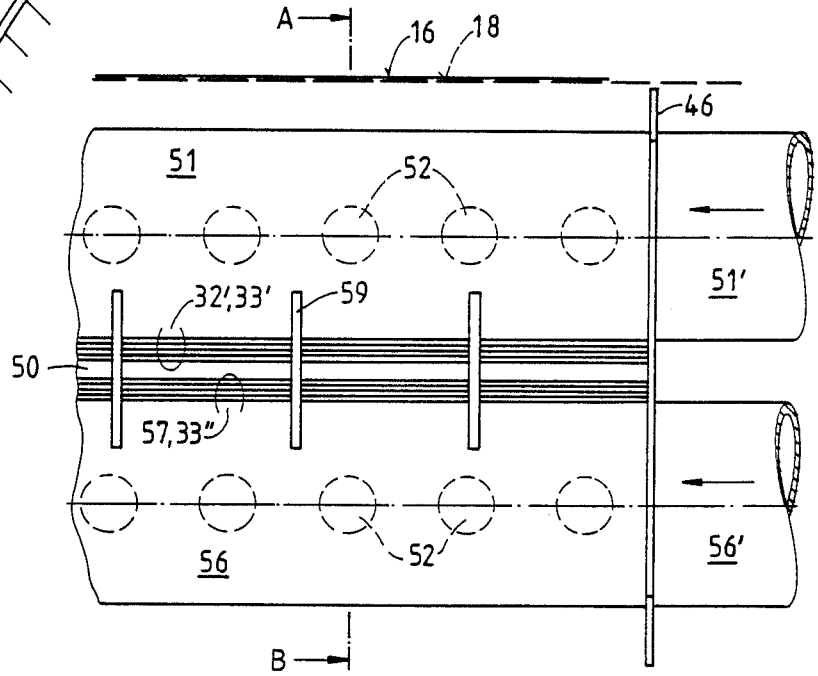
FIG. 5 shows the air guide box of the first embodiment of the present invention at view P of FIG. 4.

In FIG. 5, the air guide box 20 illustrated in FIG. 4 is shown in its view P. The air guide box 20 is delimited sideways by an end shield 46, with the backing belt 18 extending beyond the end shield 46 and the paper web 16 retracting relative to it. Connected with the end shield 46 are two blowing air feed pipes 51' and 56' which between the two end shields 46 form said pipes 51 and 56, respectively, for the blowing air supply of the air guide box 20. The two pipes 51 and 56 are fixed at a given mutual spacing through the support plates 59. This spacing results essentially across the width of the gap 50 for the air from the inlet gore 45; the width of the nozzle gaps 33', 33", and the width of the air suction channel 32'; and the channel for the air stripped from the roll 11, respectively. Provided across the length of the pipes 51 and 56 are equidistant blowing air distributing pipes 52 through which the air supplied by the blowing air feed pipes 51' and 56' is passed to the two blow boxes 47 and 48.

Figure 6:
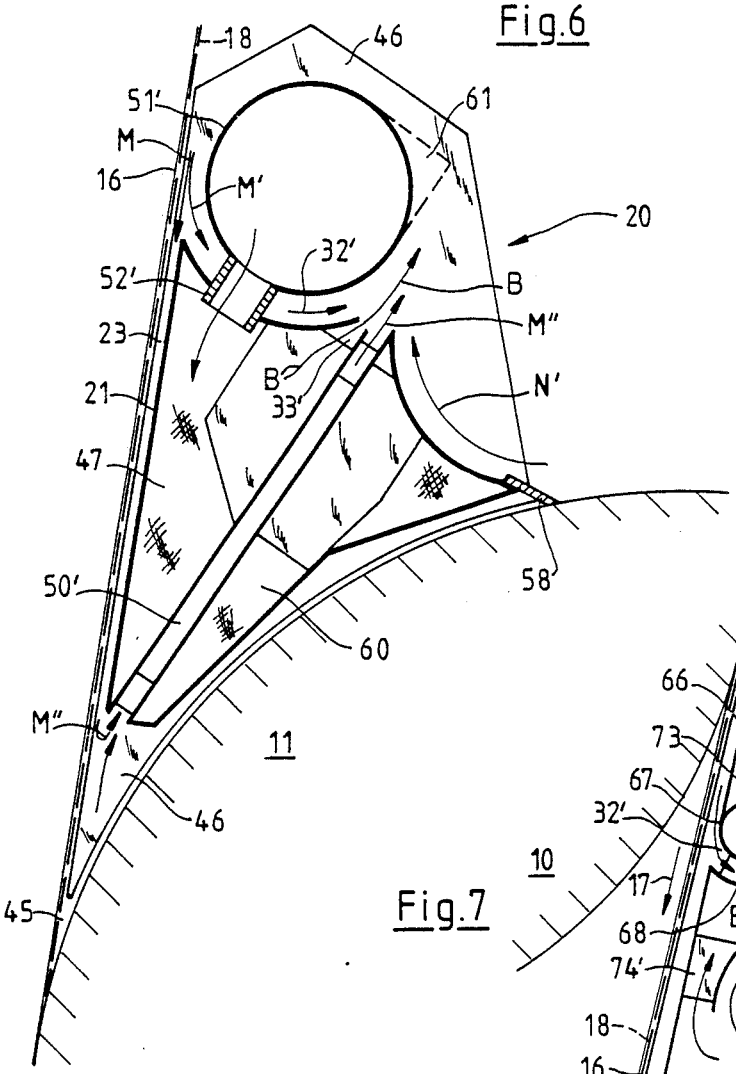
FIG. 6 shows a cross-section of an air guide box of a second embodiment of the present invention.

FIG. 6 shows a form of an air guide box 20 which is simplified compared to the embodiment shown in FIGS. 4 and 5. The part opposite the backing belt 18 and the paper web 16 which defines the air gap 23, there is a first blow box 47' provided that corresponds to the blow box 47 according to FIG. 4. Together first blow box 47', a pipe 51', and blowing air distributing pipe 52' form a self-contained blowing air system. The part M', which split off the boundary air layer M and passed into the air suction channel, is attracted by the drive jet B and ejected. The drive jet B is ejected through a nozzle gap 33'.

Arranged opposite this blow box 47', spaced by a gap 50' for the air M" to be removed from the inlet gore 45 is a second rigid, sealed box 60. Like the second blow box 48 of FIG. 4, sealed box 60 is of an acutely triangular design. It further features, on its leading edge relative to the roll 11 of its short and round side, a mechanical air stripper 58 for the air carried along by the roll 11. This stripped air N' is deflected in a curve to the gap 50' and the nozzle gap 33', respectively, and removed through the drive jet B.

In this embodiment, the part of the air guide box 20 opposite the roll 11 is thus not actively operated as a blow box; the air N' stripped off the roll 11 is influenced by the drive jet B of the blow box 47' that forms the guide wall 21. The air guide box 20 shown in FIG. 6 is complemented as well by support and stiffening plates to form a rigid, nondistorting unit; additionally it features end shields 46.

With reference to FIGS. 4 and 6, it is noted that the pipes 51 and 56 or 51' may be provided on their side away from the air guide box 20 with an air stripper edge 61 that is directed tangentially to the discharge direction of the air (indicated by broken line) to prevent the discharging air from flowing around the respective pipe and to the respective air entrance point.

Figure 7:
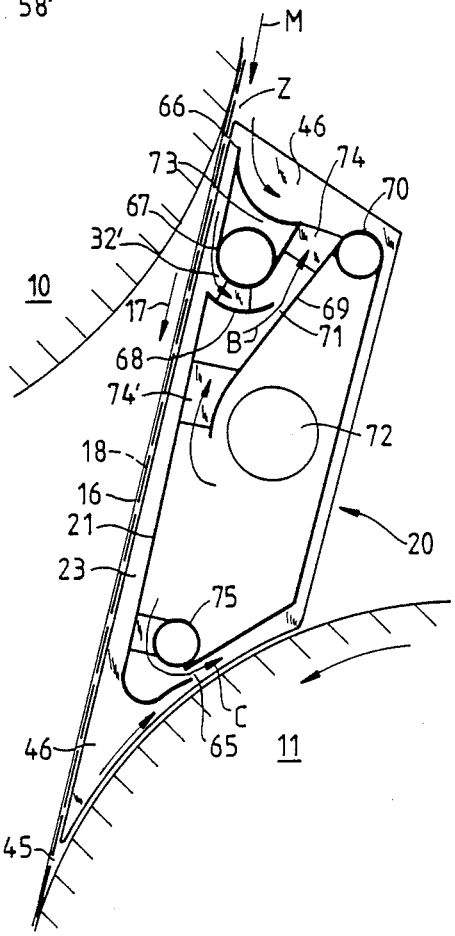
FIG. 7 shows a cross-section of an air guide box of a third embodiment of the present invention having an additional drive jet directed at a pick-up roll.

Another embodiment of an air guide box 20 is illustrated in FIG. 7. The air guide box 20 shown here differs from the air guide boxes 20 illustrated by FIGS. 4, 5 and 6 insofar as the air is removed from the inlet gore 45 through a drive jet C in the area of the part of the air guide box 20 that extends into the inlet gore 45. The air guide box 20, as a whole, has approximately the shape of a trapezoid whose long base is opposite the backing belt 18 and forms the air gap 23 while extending approximately from the departure point Z of the delivering roll 10 up to the inlet gore 45 of the pick-up roll 11. This long base forms essentially the first wall or guide wall 21.

The one short side originating from the inlet gore 45, based on FIG. 7, borders and joins in rounded fashion on the guide wall 21 and extends approximately tangentially to the peripheral line of the web guide or pick-up roll 11 to form a second wall. This short side or second wall features, viewed across the entire width (perpendicular to the drawing plane), a blow gap 65 which is so arranged and aligned that a discharging air flow, the drive jet C, blows tangentially to the roll 11 and sucks air out of the inlet gore while presenting a resistance to the air carried along by the roll 11, i.e., to its penetration into the inlet gore 45.

The other short side of the trapezoid begins with its acute angle about at the departure point Z of the delivering roll 10 and extends to reinforcement pipe 70. The acute angle is very small, so that the approaching boundary air layer N is split by a stripper edge 66, a boundary layer splitter, that is, the essential part of this air boundary layer M is prevented from entering the air gap 23.

The other long side of the trapezoid begins at reinforcement pipe 70 and extends toward web guide roll 11 generally parallel to first wall 21, and joins the second wall. The other short side extending from first wall 21 near departure point z to reinforcement pipe 70 and the other long side extending from reinforcement pip 70 to the second wall together form an intermediate wall. First wall 21, the second wall facing web guide roll 11, the intermediate wall, and sidewalls 46 define an interior region of the air guide box 20.

Behind said stripper edge 66, viewed in running direction, is an air suction slot or air suction channel 32' within the interior region and having an entrance opening for a first end thereof provided in the guide wall 21, across the air guide box 20, into which slot there may be sucked a part of the air boundary layer M that penetrates into the air gap 23, and at that, by a drive jet B from drive jet nozzle 71 which at a distance from the guide wall 21 extends into air suction channel 32 and blows against the running direction 17.

The air suction channel 32' is formed by a free space between a reinforcing pipe 67 located behind the stripper edge 66 and a channel wall 68 originating from the plane of the guide wall 21 approximately perpendicularly and extending about coaxially with the reinforcement pipe 67. Spaced from the guide wall 21, the channel wall 68 has a free edge which, spaced again, is opposed by an interior guide wall 69 which is provided from the short trapezoid side on the approach end and which through a second reinforcement pipe 70 is connected with the trapezoid side opposite the guide wall 21.

As the drive jet B is blown through the drive jet nozzle 71 between the channel wall 68 and the guide wall 69 toward a discharge channel at a second end of air suction channel 32', a suction effect is created in the air gap 23 and the air in the air gap 23 is sucked through the air suction channel 32, and discharged outside at the second end which is spaced from the first wall 21 and the second wall. The discharge channel itself is formed by the free space between said reinforcement pipes 67 and 70.

The blowing air supply for the entire guide box 20 in FIG. 7 comes from a blowing air supply pipe 72 which sideways is attached to the trapezoidal box and introduces air. This blowing air discharges as drive jet B through the gap 71 between the channel wall 68 and the guide wall 69, and as a drive jet C at the pick-up roll 11 through the blow slot 65. The trapezoidal box is sideways limited, analogous to FIGS. 4 and 6, by end shields 46, and forms a quasi enclosed blowing air system between these end shields 46.

Referring to the design of the air guide box 20 according to FIG. 7, it should be noted that the first reinforcement pipe 67 is rigidly connected with the channel wall 68, through a projection 73 extending toward the stripper edge 66; with the interior guide wall 69 fixed on the second reinforcement pipe 70; and through a number of support plates 74. The interior guide wall 69 is fixed through a support plate 74' on the guide wall 21 proper. The wall opposite the receiving roll 11, of the air guide box 20, is additionally reinforced through an additional reinforcement pipe 75, with the near-gore area of the guide wall 21.

Thus, the present invention provides an air guide box which is rigid and will not distort. The air guide boxes shown in FIGS. 4 through 7 have been illustrated only with regard to the air gaps toward the backing belt with the paper web which are responsible for the so-called foil effect. However, these air guide boxes also may be combined with the lateral ejector devices shown in FIGS. 2 and 3, so that ultimately optimal air conditions are given also in the marginal area. It is understood that in this respect an appropriate adjustment needs to be allowed for in the design between the air guide boxes and the end shields.

While the invention herein is described in terms of specific embodiments, it will be understood by those skilled in the art that numerous variations in form and detail may be made within the teachings of the present disclosure. In other instances, well-known methods and structures are not shown in detail in order not to obscure unnecessarily the present invention. Accordingly, it is to be understood that the terminology used is for the purposes of illustration rather than limitation.

What is claimed is:

1. An air guide box for stabilizing a running web, the air guide box configured to be placed within an entrance gore defined by a web and a guiding means for guiding the web, said air guide box comprising:

first wall for guiding said web, said first wall being positioned along a running path of said web, said first wall and said web defining a gap, said web carrying an air boundary layer in said gap;

second wall facing the guiding means and joining said first wall near the gore;

intermediate wall extending from said first wall to said second wall opposite the gore;

a plurality of side walls connected to said first, second, and intermediate walls, with said first wall, said second wall, said intermediate wall and said side walls defining an interior region of said air guide box;

air suction means located within said interior region for sucking air from said air boundary layer, said first wall having an entrance opening for a first end of said air suction means;

discharge means located at a second end of said air suction means for venting sucked air away from said air boundary layer, said discharge means spaced from said first wall and second wall; and drive jet nozzle coupled to said air suction means and extending into said air suction means, said nozzle directed toward said discharge means such that air flow from said air boundary layer to said discharge means increases when said drive jet nozzle blows air into said air suction means.

2. An air guide box as described in claim 1 with said air suction means located near said intermediate wall and extending transverse in direction to said first wall.

3. An air guide box as described in claim 1 with said air suction means located near said intermediate wall and extending parallel in direction with said running web at said discharge means.

4. An air guide box as described in claim 1 further comprising a pipe which endwise limits said air suction means.

5. An air guide box as described in claim 4 further comprising a wall edge adjacent to said pipe, said edge directed against said running web direction such that said edge serves to split said air boundary layer.

6. An air guide box as described in claim 4 with said pipe additionally having a means for supplying air flow to said pipe and having a plurality of air distributing pipes arranged along the width of said running web, said air distributing pipes allowing air flow from said pipe to said box.

7. An air guide box as described in claim 1 with said air suction means defining a channel within said box, said channel having an approximately uniform width.

8. An air guide box as described in claim 1 further comprising an air stripping edge adjacent to said discharge means, such that said air stripping edge limits air flow through said air suction means.

9. An air guide box as described in claim 1 further comprising a gore ventilation means coupled to empty into said air suction means for ventilation of the entrance gore between said guiding means and said running web.

10. An air guide box as described in claim 9 with said drive jet nozzle having an emptying point located between said air suction means and said gore ventilization means.

11. An air guide box as described in claim 9 further comprising a first and second blow box, a first and second pipe, and a second air suction means wherein each respective blow box has a respective air feed pipe and is paired with an air suction means to form two suction assemblies, such that said two suction assemblies are arranged symmetrically about said gore ventilation means.

12. An air guide box as described in claim 1 further comprising a second drive jet nozzle positioned at said juncture of said first wall and second wall so said second drive jet nozzle blows air along a rotating guiding means in opposition to said guiding means rotation for ventilating the entrance gore formed between said rotating guiding means and said running web.

13. An air guide box as described in claim 12 further comprising a single air feed pipe common to both said drive jet nozzle and said second rive jet nozzle.

14. An air guide box for stabilizing a running web, the air guide box configured to be placed within an entrance gore defined by a web and a guiding means for guiding the web, said air guide box comprising:

first wall for guiding said web, said first wall being positioned along a running path of said web, said first wall and said web defining a gap, said web carrying an air boundary layer in said gap;

second wall facing the guiding means and being opposite to said first wall;

a plurality of end walls extending from said first wall to said second wall;

a plurality of side walls connected to said first wall, said second wall, and said end walls, with said first wall, said second wall, said end walls, and said side walls defining an interior region of said air guide box;

a plurality of bulkheads, each said bulkhead defined by said first wall, said second wall, and one of said end walls, said bulkheads defining a main chamber therebetween in said interior region, each bulkhead defining an endwise marginal area;

a plurality of air suction means located in each of said endwise marginal areas for sucking air from said air boundary layer, said first wall having an entrance opening for a first end of each said air suction means;

a plurality of discharge means located at a second end of each said air suction means for venting sucked air away from said air boundary layer; and a plurality of drive jet nozzles, each said nozzle coupled to a respective air suction means and extending into said air suction means directed toward said discharge means such that air flow from said air boundary layer to said discharge means increases when said drive jet nozzle blows air into said air suction means.

* * * * *